United States Patent [19]

McDonald

[11] 4,158,988

[45] Jun. 26, 1979

[54] SELF-RESPONSIVE FLUID MEANS FOR ANTI-CAVITATION

[75] Inventor: Raymond F. McDonald, Winneconne, Wis.

[73] Assignee: J. I. Case Company, Racine, Wis.

[21] Appl. No.: 828,957

[22] Filed: Aug. 29, 1977

[51] Int. Cl.[2] ..... F15B 13/042

[52] U.S. Cl. ..... 91/420; 91/437; 91/447

[58] Field of Search ..... 91/437, 420, 446, 447; 60/468, 494, 460, 461; 137/87

[56] References Cited

U.S. PATENT DOCUMENTS

| | | | |
|---|---|---|---|
| 2,590,454 | 3/1954 | Pilch | 91/420 |
| 2,625,168 | 1/1953 | Charlson | 91/420 X |
| 3,386,471 | 6/1968 | King | 91/420 X |
| 3,402,553 | 9/1968 | Mercier | 60/460 |
| 3,442,179 | 5/1969 | Comer | 91/454 X |

*Primary Examiner*—Irwin C. Cohen
*Attorney, Agent, or Firm*—Arthur J. Hansmann

[57] ABSTRACT

A self-responsive fluid means for anti-cavitation, such as when a fluid motor is rotating in a manner beyond that induced by the fluid pressure fed thereto, and thus the motor itself acts in the nature of a pump to produce a cavitation effect. Thus, there is a fluid motor, a valve controlling flow thereto, a pump, and an additional valve which directs the exhaust from the fluid motor and back to the motor itself, under certain conditions of operation, all to avoid the cavitation effect. The latter valve includes two fluid inlet openings and a movable closure which controls fluid flow to a fluid outlet opening; and pressure relief valve are incorporated in that valve and thus permit and control flow to the reservoir when pressure is at a certain magnitude.

4 Claims, 4 Drawing Figures

SELF-RESPONSIVE FLUID MEANS FOR ANTI-CAVITATION

This invention relates to a self-responsive fluid means for anti-cavitation, and, more particularly, it relates to a fluid means wherein a fluid system of a pump and a valve and a motor have an additional valve which directs the exhaust flow from the motor back to the other said valve and then to the motor itself, under certain conditions of operation.

BACKGROUND OF THE INVENTION

The prior art is aware of various fluid systems for directing fluid flow to and from fluid motors, and it is also aware of various arrangements of fluid valves for the purpose mentioned. Prior U.S. patents which show some type of hydraulic system are Nos. 2,386,291 and 2,423,264 and 2,466,485 and 3,370,602. These patents only show arrangements of hydraulic or fluid systems which employ a driven member or motor and a valve for controlling flow thereto, and the last three patents mentioned also show a pump and an equalizing or diverter valve in addition to a type of control valve in the system.

The prior art also reveals various arrangements for fluid valves, such as seen in U.S. Pat. Nos. 2,593,185 and 2,971,552 and 3,060,953 and 3,200,830 and 3,437,103 and 3,554,213 and 3,590,844 and 3,722,524 and 3,924,650. These patents all show various arrangements for valves having spools serving as closure members and with the spools being responsive to the fluid pressure within the valve itself. However, these valves are fundamentally only flow divider valves where flow will enter the valve in one opening and will leave the valve through two other openings. In that regard, the latter three of the first aforesaid group of patents also show divider valves, and U.S. Pat. Nos. 2,466,485 and 3,370,602 particularly show spools with end faces thereon disposed in separated chambers within the valve body and having passageways leading to the chambers, all for shifting the spool according to fluid pressure on those spool faces. However, those are still only diverter valves, rather than a combiner type of valve which, as in the present instance, takes fluid from two sources and combines it in an outlet flow. As such, this is the advantage and object of the present invention.

However, U.S. Pat. No. 3,437,103 can be used as a combiner type of valve where the fluid is taken from two sources and combines it into one outlet. Nevertheless, that prior art does not disclose a combiner wherein a fluid is accepted from two sources and combined at some flow proportion to an outlet, and thus it does not select fluid from one of two sources to direct it to the desired outlet or user system. As such, the present invention has as its object the provision of a valve which receives fluid from two sources and, at some proportionate pressure or flow between the two sources, the valve reacts to direct the flow from one source and to direct only it to the user system. Further, this invention has as its objective the accomplishment of the aforementioned improvements by utilization of simplified apparatus, such as the self-responsive selector valve mentioned, which is readily and easily inserted into a fluid system of a pump, a control valve and a fluid motor.

Still further, it is an object and advantage of this invention to provide apparatus wherein a self-responsive valve is incorporated in a system and arranged so that when the powered element of the system requires excessive fluid, the valve will react and in essence recycle the fluid through the powered element or apparatus itself. Simultaneous with that action, the self-responsive valve of this invention will divert the flow from the supplying pump and to the reservoir. Therefore, the apparatus of this invention is particularly useful in situations such as vehicle transmissions, and particularly tractor transmissions where, for instance, when the tractor is running downhill and the transmission is thus driven through that type of movement, the fluid motor arranged with the transmission will cause excessive flow of the fluid, and that fluid can be diverted through the valve employed herein and back to the driven motor itself, to thus avoid anti-cavitation of the system. When the cavitation of the drive motor of the aforementioned system occurs, complete loss of vehicle or tractor speed control results, and thus the apparatus of this invention is utilized to avoid that uncontrolled condition. Some of the prior art attempts to solve this problem result in an arrangement where there is only one available downhill tractor speed, or there may be an arrangement for excessive loading of the engine itself, or there may be an arrangement to provide for only a short time duration of downhill control. However, the present invention provides for the complete and self-responsive control of the tendency for the system to cavitate, as mentioned.

Other objects and advantages will become apparent upon reading the following description in light of the accompanying drawings.

DETAILED DESCRIPTION OF THE PREFERRED EMBODIMENT

Figure 1:
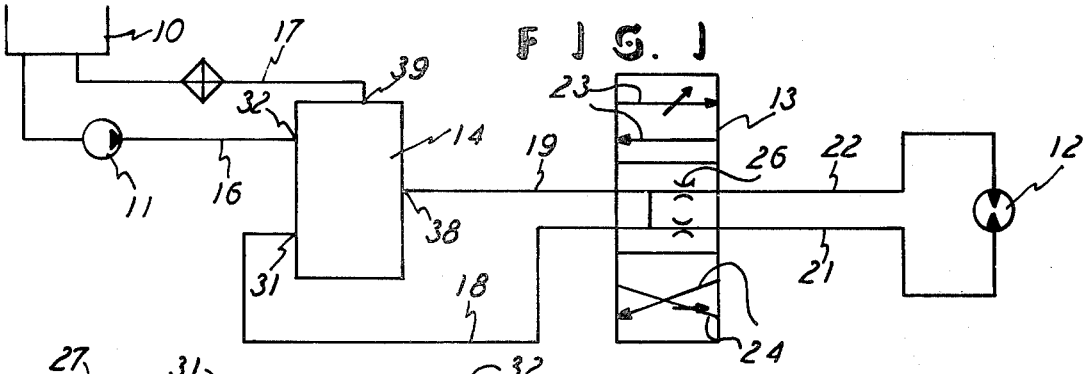
FIG. 1 is a schematic view of an entire fluid system arranged according to this invention.

FIG. 1 shows the fluid system which includes a supply or reservoir 10, a fluid pump 11, a fluid motor or driven member 12, and a fluid valve 13 and a fluid valve 14. The aforesaid elements are all inter-connected with the fluid lines therebetween, as shown in FIG. 1 such that a fluid line 16 extends between the pump 11 and the valve 14 for directing fluid to the valve 14, and a fluid line 17 connects from the outlet of the valve 14 and extends back to the supply or tank 10. Also, fluid lines 18 and 19 extend between the two valves 13 and 14, and fluid lines 21 and 22 extend between the motor 12 and the valve 13.

FIG. 1 further shows that the valve 13 is of a control or shiftable type having pairs of passageways 23 which can be connected with the lines 18 and 19 and the lines 21 and 22 for directing fluid to the motor 12 for one direction of rotation of the motor 12. Also, the valve 13 has passageways 24 which can be positioned for flow communication with the lines 19 and 21 and the lines 22 and 18, respectively, for reverse rotation or powering of the unit or motor 12, all as indicated by the showing of the valve 13 and as will be readily understood by anyone skilled in the art. The valve 13 also has restrictors 26 shown thereon, and the valve 13 is shown in a position to flow communicate the valve 14 with the motor 12 to have fluid flow to and from the motor 12 in the respective lines or passageways shown in FIG. 1.

Figure 2:
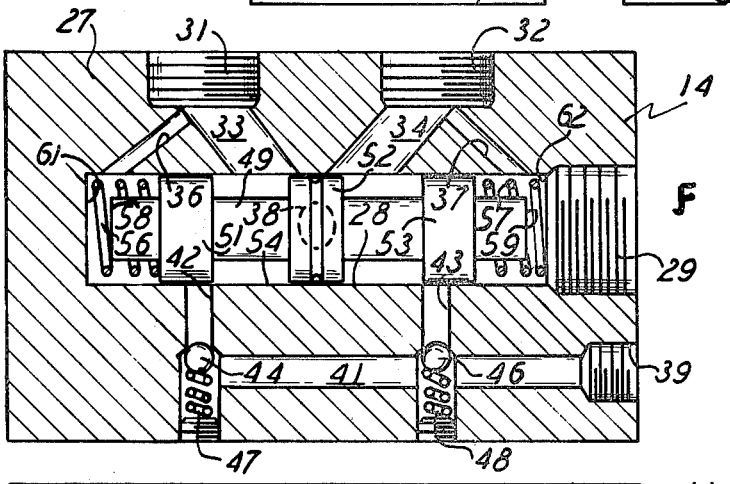
FIGS. 2, 3, and 4 are enlarged sectional views of one of the valves shown in the system in FIG. 1.
Figure 3:
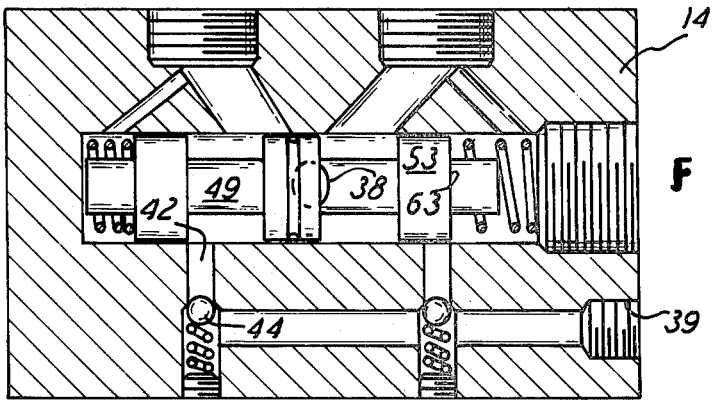
Figure 4:
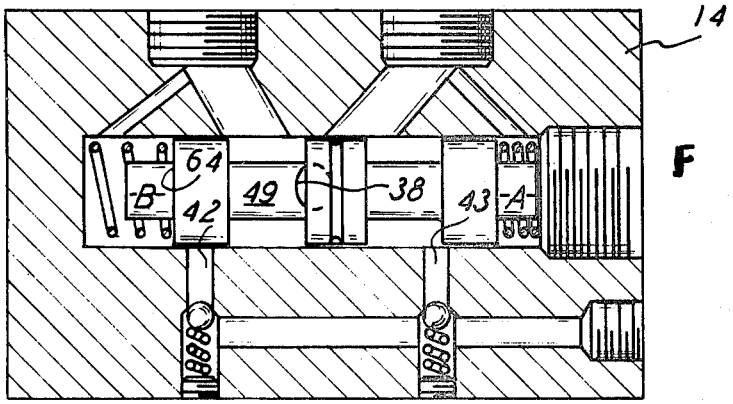

An important feature of the entire system is the valve 14 which is shown in detail in FIGS. 2, 3, and 4. With the inclusion of the valve 14 and the system and by virtue of the arrangement of the valve 14, the fluid can be re-cycled relative to the motor or powered unit 12, and thus in the event that the motor 12 is running at a fast speed beyond that which is actually created by the fluid supplied from the pump 11, such as when the motor 12 is in a tractor transmission which is running downhill, then the fluid can be re-cycled relative to the motor 12 and thus avoid a cavitation condition in the system.

The valve 14 has a body 27 and an interior chamber 28 closed off by a plug 29. Two inlet openings 31 and 32 extend into the body 27 and flow communicate with the chamber 28 through extensions or passageways 33 and 34 and 36 and 37, as shown. Thus, fluid flowing to the inlet openings 31 and 32 will go to the chamber 28 through any or all of the four passageways just described, and those passageways are actually parts of or extensions to the inlet openings 31 and 32.

The valve body 27 also has a fluid outlet opening 38 which flow communicates with the interior chamber 28 and extends to the exterior of the valve body 27 so that fluid can flow from the valve body 27 in a manner hereinafter described. Also, the valve body 27 has a fluid outlet opening 39 which extends in the body 27 through its passageway 41 and flow communicates with the passageways 42 and 43 which are in flow communication with the interior chamber 28, all as shown. Check valves, in the form of balls 44 and 46 are disposed in the outlet passageway described, and compression springs 47 and 48 thereagainst the respective balls 44 and 46 to hold them in the fluid-tight position relative to the passageways 42 and 43, respectively, and thus preclude the escape of fluid through the outlet opening 39 until the fluid reaches the minimum pressure of the check valves 44 and 46, and that pressure might be 60 psi, for one example.

Finally, the valve 14 has a closure in the form of the spool 49 which is movably disposed in the body 27 and has fluid sealing portions 51, 52 and 53 which are in fluid-tight and sliding contact with the cylindrical wall 54 defining the chamber 28. Thus the three sealing portions 51, 52, and 53 respectively block the flow of fluid through the inlet and outlet openings of the valve 14, in a manner hereinafter described. Compression springs 56 and 57 are disposed on opposite ends of the spool 49 and are effective for placing the spool 49 in the center position which is the position shown in FIG. 2. Also, the spool 49 has end walls 58 and 59 which can respectively abut the housing end wall 61 and the end 62 of the plug 29.

Next, describing the operation of the valve 14, FIG. 3 shows the spool 49 shifted to the left, from the FIG. 2 position, and thus the outlet opening 38 is uncovered and therefore fluid can flow through the inlet opening 32 and to the outlet opening 38. The opening 38 is identified in FIG. 1, and thus the flow will go from the valve 14 and through the line 19 to the valve 13 and then to the motor 12 for driving the motor, as desired.

To accomplish the self-responsive or automatic position of the valve 14, as seen in FIG. 3, it will be understood that the pump 11 connects through the line 16 to the inlet 32 and thus pump pressure is presented to the valve chamber 28 in the passageway 34 and also the passageway 37. The fluid pressure presented through the passageway 37 is effective on the right-hand end of the spool 49, as viewed in FIG. 3, such as on the end face or surface 63, and that causes the spool 49 to shift from the FIG. 2 position to the FIG. 3 position and thus open the outlet 38 as shown in FIG. 3. Further, in the FIG. 3 position, the spool sealing portion 53 closes the passageway 43 so fluid cannot escape through the passageway 43 and thus the pressure from the pump 11 is applied to the motor 12.

It will be further noticed that the motor 12 is connected to the inlet 31 through the connecting line 21 and the valve 13 and the connecting line 18, and thus return flow from the motor 12 is presented to the inlet opening 31 in the FIG. 3 position. That return flow is presented to the passageway 42, as can be seen in FIG. 3, and when the pressure reaches the 60 psi selected, then the valve 44 will open and allow that flow to continue to the outlet opening 39 which is connected to the return tank 10 through the line 17.

With the aforementioned arrangement and functioning, the pump 11 will be driving the motor 12, as desired.

If, under a condition where the motor 12 is rotating to demand more fluid than that supplied by the pump 11, such as when the motor 12 is in a vehicle transmission which is now running under its own power in a downhill type of operation, then the pump 27 controls the fluid system and avoids the anti-cavitation by the automatic and self-responsive action of the spool 49 which will then shift to the position shown in FIG. 4. In this condition of the overrun by the motor 12, the fluid pressure in the cavity A on the right-hand side of the spool 49 and as supplied through the passageway 37 will diminish and the fluid pressure will continue and even increase in the passageway 36 and thus present itself to the chamber B to the left of the spool 49. That is, the pressure in chamber B will be greater than the dissipated pressure in chamber A, all due to the aforementioned running of the motor 12 by external means, and thus the spool 49 will shift to the right, as shown in FIG. 4. That will cause the spool sealing portion 51 to block the flow to the outlet passageway 42 and to open the flow to the outlet passageway 43 and also leave the flow to the outlet opening 38. To accomplish the shifting of the spool 49 to the right, as mentioned, the fluid pressure was presented to the spool surface 64 and that of course was an unbalanced pressure which caused the spool 49 to shift as mentioned. Therefore, the output from the pump 11 is directed to the chamber 28 and to the then exposed outlet passageway 43 and the outlet opening 39 and thus to the tank 10. Simultaneously, the fluid from the motor 12 is directed into the inlet opening 31 and to the valve outlet opening 38 and thus back to the motor 12 and this therefore regulates the flow to the motor 12 and thus avoids the cavitation and controls the travel speed, in the instance of using the motor 12 in a vehicle transmission, as mentioned above. Again, the outlet pressure for the valve 46 may be 60 psi, and therefore the pump pressure will be directed through the check valve 46 when it exceeds the specified amount.

In this arrangement, the valve 14 is provided with a fluid closure which is free to move in the chamber 28 according to fluid pressure presented to the chamber 28, as described, and thus the valve 14 is self-responsive. Also, the valves 44 and 46 are pressure released valves which are in respective fluid-flow communication with the two inlet openings 31 and 32, and they are also in fluid-flow communication with the one valve outlet opening 39. Further, the spacing between the passageways 42 and 43, and also relative to the outlet opening 38, is related to the spacing between the valve closure portions 51 and 52 and 53, such that the outlet 38 and the passageway 43 are closed by the closure portions 52 and 53 in FIG. 2; and the outlet 38 is opened when the passageway 43 is closed, respectively by the closure portions 52 and 53, in FIG. 3, and the passageway 42 is open in FIG. 3; and the outlet 38 and the passageway 43 are opened by the closure portions 52 and 53, in FIG. 4, while the passageway 42 is closed by the closure portion 51 in FIG. 4. Thus, the relative spacing between the closure portions and the outlets and passageways is as shown and described herein for the purposes mentioned.

What is claimed is:

1. A self-responsive fluid means for anti-cavitation, comprising a fluid pump and a fluid valve and a fluid motor and fluid connections fluid-flow connected between said pump and said valve and said motor for directing the flow of fluid from said pump to said motor, a second fluid valve fluid-flow connected between said pump and said motor and having two spaced-apart fluid inlet openings and two spaced-apart fluid outlet openings and having a chamber with said openings opening thereto and a shiftable valve closure for controlling the flow of fluid between said inlet openings and said outlet openings, the two said fluid inlet openings being separately and respectively fluid-flow connected with said pump and said motor and arranged to receive the exhaust fluid from said motor, one of said fluid outlet openings being fluid-flow connected with the first-mentioned said fluid valve for directing fluid thereto, the other of said fluid outlet openings being fluid-flow connected with a fluid supply for exhausting fluid thereto, each of said inlet openings having two spaced-apart passageways in fluid-flow communication with said chamber, said closure having two spaced-apart fluid-sealing pressure responsive portions respectively interposed between each two of said passageways for shifting of said closure in accordance with fluid pressures in said chamber and for blocking flow to said other of said fluid outlets, said closure having an additional fluid-sealing portion disposed intermediate the other said portions and each of said inlet openings, and means biasing said closure to a neutral position where in said additional fluid sealing portion blocks said one of said outlet openings whereby relative inlet pressures acting on said valve closure causes shifting of said valve closure to positions connecting a respective inlet opening with said one of said outlet openings.

2. The self-responsive fluid means for anti-cavitation as claimed in claim 1, wherein the first-mentioned said fluid valve includes a movable valve closure and a plurality of fluid passageways in the latter said valve closure for selective directing of fluid to said motor.

3. The self-responsive fluid means for anti-cavitation as claimed in claim 1, wherein said other of said fluid outlet openings includes two fluid passageways, and said second fluid valve includes two fluid pressure relief valves respectively disposed intermediate said chamber and each of said passageways of the other of said fluid outlet openings, for controlling the flow of fluid to said fluid outlet openings in accordance with the fluid pressure thereat.

4. The self-responsive fluid means for anti-cavitation as claimed in claim 1, wherein said other fluid outlet opening is spaced from each of said two fluid passageways a distance less than the spacing between said fluid closure portions, for said portions to simultaneously close said other of said fluid outlet opening and flow from at least one of said passageways.

* * * * *